United States Patent [19]

Mondor, III

[11] Patent Number: 4,712,298

[45] Date of Patent: Dec. 15, 1987

[54] FLAT WOVEN CABLE FOR INSULATION DISPLACEABLE CONNECTOR TERMINATION AND METHOD

[75] Inventor: Edward J. Mondor, III, Greenville, S.C.

[73] Assignee: Woven Electronics Corporation, Mauldin, S.C.

[21] Appl. No.: 863,967

[22] Filed: May 16, 1986

Related U.S. Application Data

[63] Continuation-in-part of Ser. No. 830,725, Feb. 19, 1986.

[51] Int. Cl.[4] ..... H01R 4/66

[52] U.S. Cl. ..... 29/861; 29/857

[58] Field of Search ..... 29/861, 857; 339/97 R, 339/97 P, 98, 99 R; 174/117 M

[56] References Cited

U.S. PATENT DOCUMENTS 3,447,120 5/1969 Rask et al. ..... 174/117 M 4,073,560 2/1978 Anhalt et al. ..... 339/99 R

*Primary Examiner*—Timothy V. Eley

*Attorney, Agent, or Firm*—Cort Flint

[57] ABSTRACT

A woven high speed electrical transmission cable and method are disclosed in which an insulation displaceable connector (24) is utilized to terminate flat woven cable (10). A plurality of signal conductors (12) are arranged generally side by side in the cable extending longitudinally in the warp direction. Warp elements (A,14) and weft elements (16) are interwoven with signal conductors (12) to bind the signal conductors in a prescribed weave pattern. The warp elements are polymeric mono warp strands (A) which include a central reinforcing core (40) of reinforcing fibers (20). A soft pliable polymeric material (22) encapsulates reinforcing fibers (20). Polymeric mono strands have a well defined diametric dimension to accurately fix the lateral spacing of signal conductors (12) in cable (10). The polymeric material of polymeric warp strands (A) readily yields to prongs (30) of an insulation dispaceable type connector (24) so that the connector prongs may be inserted into the cable without bending or damage to the prongs (30). Reliable displacement of insulation (13*a*) of signal conductors (12) may be had for electrical contact between prongs (30) and conductor wires (13*b*).

14 Claims, 9 Drawing Figures

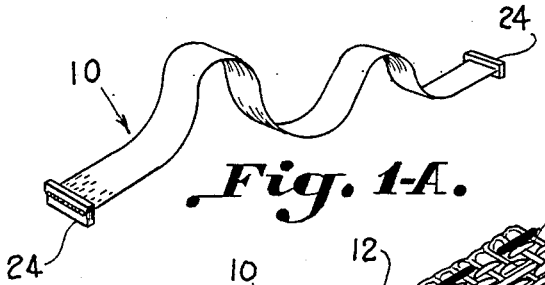
Fig. 1-A.
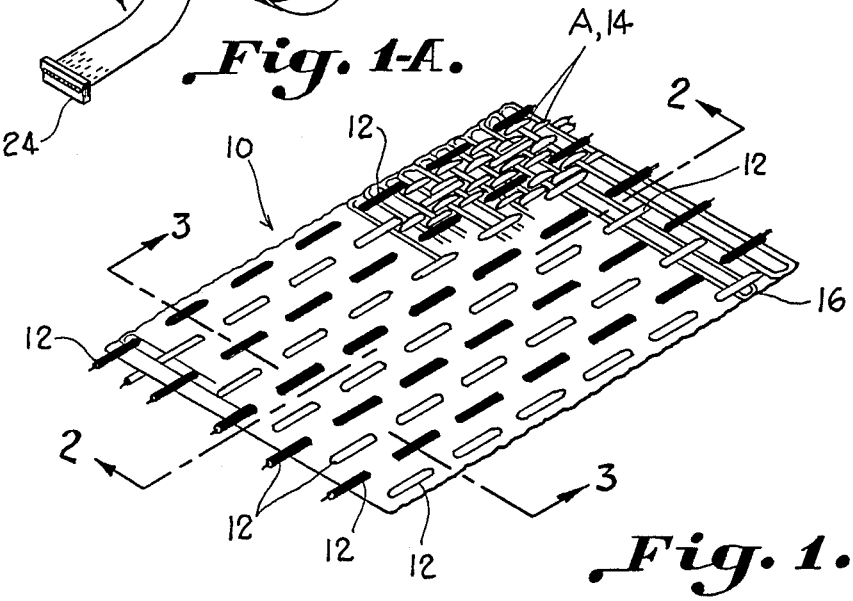
Fig. 1.
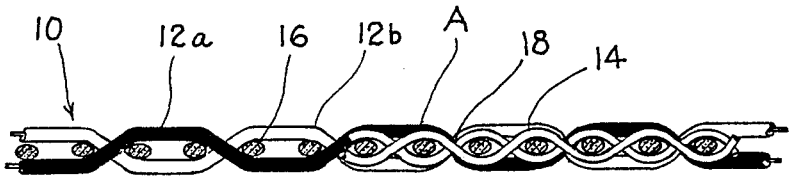
Fig. 2.
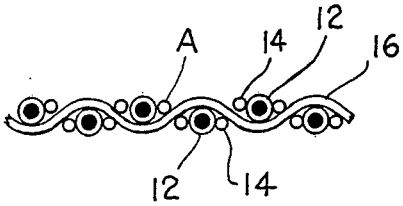
Fig. 3.
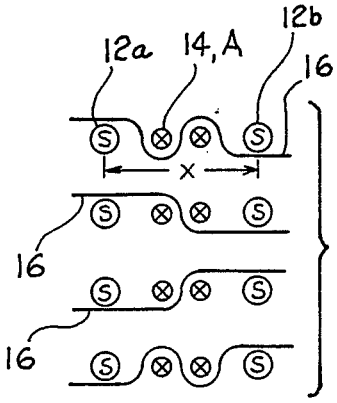
Fig. 3-A.

FLAT WOVEN CABLE FOR INSULATION DISPLACEABLE CONNECTOR TERMINATION AND METHOD

BACKGROUND OF THE INVENTION

This is a CIP of Ser. No. 830725 of 2/19/86.

The invention relates to a flat woven electrical transmission cable and method for termination by means of a terminal connector at each end of the cable, and, in particular by means of an insulation displaceable connector.

Woven electrical transmission cables are utilized to transmit high speed electrical signals in such equipment as computers, tele-communication, aircraft, etc., where accuracy and reliability of signal transmission is a problem of utmost concern.

An insulation displaceable connector (IDC) typically includes a base connector and a cover for terminating the ends of laminated or bonded film cable, for example, as shown in U.S. Pat. No. 4,410,229. The IDC base includes a plurality of forked connector prongs connected to pin sockets. The prongs cut and displace the insulation around a conductor wire to make electrical contact between the conductor and the pin socket. Application of the IDC has been made mainly to laminated or extruded type flat cables since it is necessary to precisely space the conductors laterally for accurate engagement with the prongs of the IDC. In the case of laminated cable the conductors are precisely laterally spaced by heat bonding to thermal plastic film.

U.S. Pat. No. 4,381,426 discloses a flat electrical transmission cable in which the conductors are maintained in a precisely laterally spaced relationship by heat bonding to thermal plastic film. The cable is woven in a first section in which conductor pairs are twisted together. There is a second section in which the previously twisted conductor pairs are straight and parallel. In the straight parallel section, an IDC may be inserted into the cable to make electrical connector and termination of the conductors. One problem with this type of cable is that the main section of the cable, in which the conductor wires are twisted in order to reduce cross talk, is of a predetermined length. The cable must be terminated at the section where the conductor wires are straight and parallel. Typically, such a cable is woven with the twisted pair section being eighteen inches or more. It is typical for the cable to be purchased spooled and then later terminated by a cable assemblr. The cable assembler may assemble cable in many different lengths in order to meet the requirements of a particular electrical wiring application. If, for example, a cable two inches long is needed, the assembler must still use a cable eighteen inches long since the twisted pair cable can only be terminated at the ends where the conductors are straight and parallel. This is an expensive and inefficient use of electrical transmission cable.

In the art of flat woven cable, it has been common to terminate flat woven cable, which may be woven in a variety of weave patterns, with a conventional pin/-socket connector. The flat woven cable may be cut in any desired length. The ends of the conductors bound in the flat woven cable are freed and stripped of insulation. The conductor wires are then soldered or otherwise connected to the pins of the connector. The entire assembly may be potted to assure strain relief and insulation. This termination is labor and time extensive which increases the cost of the cable. The construction of conventional flat woven cables has been to bind insulated conductors with different weaving arrangements of warp and weft yarns. The multifilament warp binders may be woven half up and half down to prevent relative sliding and improve stability. These yarns typically include synthetic multifilaments such as nylon, polyester, kelvar, etc. which have high strength and abrasion resistance which are normally desirable characteristics. The IDC type termination and method, developed mainly for laminated cables, includes connector prongs that may become easily bent when inserted into the conventional multifilament yarns. In the case of flat woven cables having synthetic warps that may not yield to prong insertion, the end result may be unreliability in electrical connection.

U.S. Pat. No. 4,508,401 discloses a terminal connector for a flat woven cable of the type cable wherein the conductor wires are floated out of the weave pattern of the cable for termination. While this type of termination may be desirable in some applications, the length of cabling that can be terminated is not variable. If a shorter cable is needed, the entire original length of the cable must be utilized.

Accordingly, an important object of the present invention is to provide a flat woven cable for electrical transmissions and method which may readily be terminated with an insulation displaceable connector inserted directly into the woven cable.

Another object of the invention is to provide a flat woven cable constructed in a manner that an insulation displaceable connector may be easily inserted through the woven cable structure without damage to the prongs to the connector.

Another object of the invention is to provide a woven cable and method in which woven warp elements are included in the woven cable which accurately space the warp conductors in the cable with precise center to center spacing while readily yielding to penetration of an insulation displaceable type connector without prong damage.

Still another object of the invention is to provide a flat woven cable for transmission of high speed electrical signals in which pliable polymeric mono strands are included as warp elements in the woven construction of the cable which accurately space the signal conductors and facilitate the insertion of an IDC type connector.

Still another object of the invention is the provision of a flat woven electrical transmission cable which can be readily cut into any desired length and terminated by an insulation displacement connector.

SUMMARY OF THE INVENTION

The above objectives are accomplished according to the present invention by a flat woven cable and method in which warp conductor elements are included which are of a polymeric mono strand material of a non-filamentary nature of sufficient size to space the warp signal conductors precisely in their center to center spacing for alignment with the connector prongs of an IDC. The polymeric mono strands include a polymeric material such as polyvinyl chloride which may encapsulate reinforcing core yarns. The outside layer of polyvinyl chloride is sufficiently thick and pliable to provide for cable penetration of the prongs of the IDC connector without damage to the prongs as may adversly affect the integrity of the electrical connection or physical structure of the cable. As the prongs penetrate the woven cable, reliable piercing and displacement of insulation surrounding the signal conductor wire occurs.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view illustrating construction of a woven electrical transmission cable for IDC termination and method according to the invention;

FIG. 1A is a perspective view of a woven electrical transmission cable woven and terminated in accordance with the invention;

FIG. 2 is a sectional view taken along line 2—2 of FIG. 1;

FIG. 3 is a sectional view taken along line 3—3 of FIG. 1;

FIG. 3A is an illustration of a four shed repeat weave pattern for the cable of FIG. 1;

DESCRIPTION OF A PREFERRED EMBODIMENT

Figure 4:
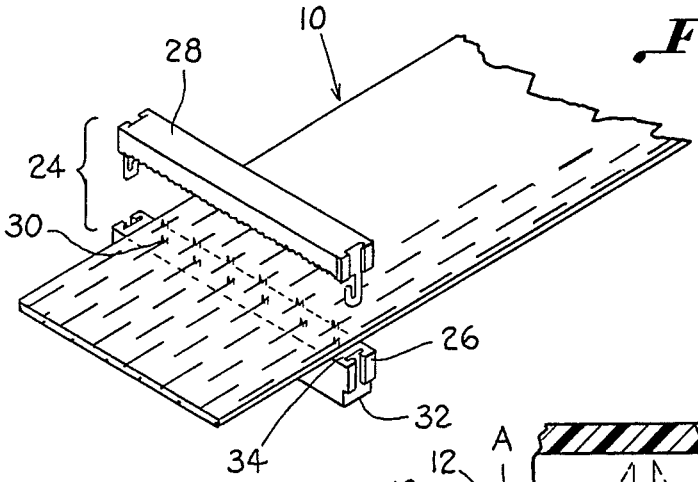
FIG. 4 is a perspective view illustrating a flat woven electrical transmission cable and termination with an IDC in accordance with the invention.
Figure 5:
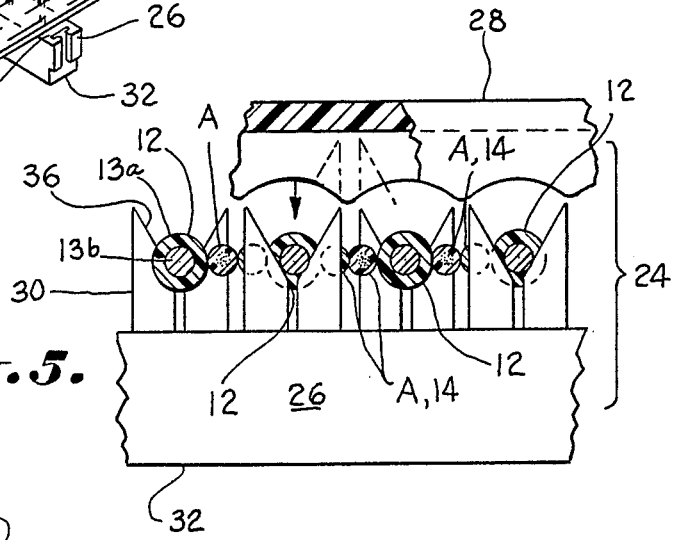
FIG. 5 is an enlarged front elevation illustrating flat woven electrical transmission cable terminated with an IDC in accordance with the invention.
Figure 6:
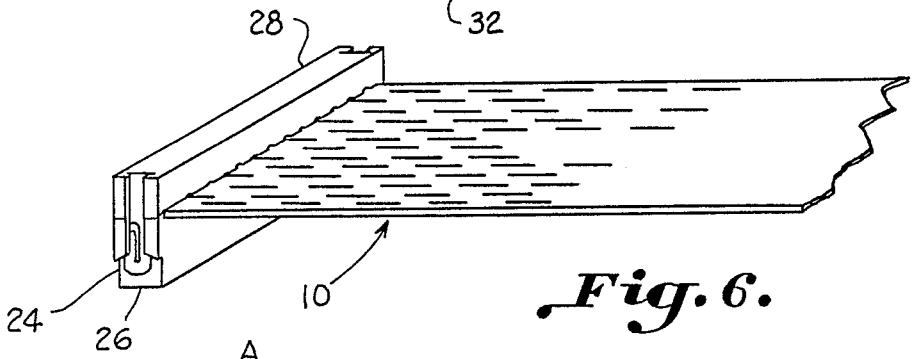
FIG. 6 is a perspective view illustrating a flat woven cable terminated with an IDC according to the invention.

This application is a continuation-in-part of copending application Ser. No. 830,725, filed on Feb. 19, 1986 entitled Method and Woven Cable Termination with Insulation Displaceable Connector.

The invention relates to a flat woven electrical transmission cable which is woven in such a construction and method that the cable may be terminated with a conventional insulation displaceable connector (IDC).

The woven transmission cable includes a number of electrical signal conductors extending longitudinally in the warp direction which undulate in a weave pattern one hundred eighty degrees out of phase. The signal conductors are woven in a two up, two down undulating pattern. There are a number of warp elements which consist of polymeric mono strand, such as polyvinyl chloride (PVC) yarn woven between the signal conductors as spacers in a one up, one down pattern and the PVC strands undulate one hundred eighty degrees out of phase. This undulating pattern prevents roll-over of the PVC strands. The prevention of the PVC strands from rolling over each other serves to accurately maintain the spacing between conductors. Further, in accordance with another aspect of the invention the weaving of the PVC strands one hundred eighty degrees out of phase creates cross over spaces or intersection points where the PVC strands may be fused together by heat treatment.

The signal conductors are woven are hundred eighty degrees out of phase to minimize cross talk between adjacent conductors. The non-parallel weave construction of the signal conductors in the weave pattern minimizes intersecting magnetic fields and tends to minimize the noise produced in adjacent conductor lines.

The PVC strands which form the warp elements may include a core of reinforcing fibers. It has been found that this type of construction provides the strength that is required when the PVC strands are tensioned during weaving. However, the PVC material surrounding the reinforcing core yarns facilitates penetration of the prongs of the IDC into the woven cable quite readily. Suitable textile reinforced PVC strands are available from Engineered Yarns of Covington, R.I.

Referring now in more detail to the drawings, FIG. 1 illustrates a flat woven cable designated generally as 10 having a number of signal conductors 12 woven in the cable in the warp direction which is longitudinal. Further woven in the warp direction is a number of warp elements 14 which are woven with the warp signal conductors 12 and a weft element 16 to form the woven cable. The woven cable 10 may be continuously woven in any length. The woven cable may be cut across its with to form an individual cable of any desired length. The severed cable length may be terminated as will be hereinafter described in a quick and easy manner utilizing an insulation displaceable connector (IDC). The weft element 16 is preferably multifilament polyester yarn. Only a portion of the full weave construction is illustrated in detail in FIG. 1.

The illustrated weave pattern can best be seen in FIGS. 2 and 3A wherein the signal conductors 12 are woven over two and under two picks of the weft element 16. Adjacent signal conductors, for example 12a and 12b are woven one hundred eighty degrees out of phase with respect to each other to minimize cross talk. The warp elements 14 are woven in a one up and one down pattern with the picks of weft element 16. Adjacent warp elements 14 are also alternately woven one hundred eighty degrees out of phase with respect to each other to define crossing points of intersection 18, the purpose of which will be more fully described hereinafter.

Referring to FIG. 3A, a four shed pick repeat pattern is illustrated in which the weft yarn 16 repeats itself in the illustrated pattern on every four picks of weft yarn 16. While the above identified weave construction of woven cable 10 is particularly advantageous in regards to the invention for reasons which will become more fully apparent hereinafter, it is to be understood, of course, that other weave constructions may also lend themselves to use with the invention.

In accordance with the woven cable and method of the present invention, warp elements 14 include a polymeric warp strand means A which is a mono-strand of polymeric material. The polymeric warp strand includes reinforcing fibers which are imbedded or encapsulated in the polymeric material 22. In a preferred embodiment, the polymeric material 22 may be an extruded polyvinyl chloride strand having a reinforcing core consisting of reinforcing fibers 20 which may be any suitable textile fibers such as multifilament polyester. Of course, neither the polymeric material 22 nor the reinforcing fibers 20 are conductive. The reinforcing fibers 20 may be any filamentary, strand, or like elongated reinforcing elements of any suitable reinforcing material. The polymeric material 22, for example polyvinyl chloride (PVC), is sufficiently pliable to readily yield to the insertion of the connector prongs of the insulation displaceable connector.

As can best be seen in FIG. 4, an insulation dispalceable connector 24 is illustrated having a base 26 and a cover 28. The base has a plurality of electrical terminals in the form of forked shaped prongs 30. The termination prongs 30 extend through the base from a mating face 32 to a cable receiving face 34 in a conventional manner. A tapering slot 36 defined by the fork shaped prongs 30 receives a signal conductor for piercing and displacing the insulation 13*a* of conductor 12 for electrical contact with conductor wire 13*b*. The prongs are generally constructed of a thin, sharp metal which may be easily bent. The mating face 32 of the base may be constructed to have a plurality of sockets (not shown) for receiving pins of a corresponding pin connector for making connection therewith in a conventional manner. For example, the pins may be on a circuit board or other termination board. Thus, the electrical connection made possible by the displacement of the signal conductor insulation may be routed to a desired location.

While the use of conventional insulation displacement connectors, as illustrated at 24, have been commonly used with laminated cable, application of IDC technology has not been readily made to woven cables. It has been found that the multifilament warp yarns commonly used in woven cables may not readily permit penetration of the connector prongs 30 of an insulation displacement connector. The prongs may have difficulty in cutting or penetrating through the warp yarns woven in the cable in order to pierce the insulation of the signal conductors. The result may be that a connector prong becomes bent or is otherwise brought out of alignment. Accurate piercing and reliable displacement of the insulation on the signal conductor does not occur. Thus, unreliable electrical connection results.

Figure 7:
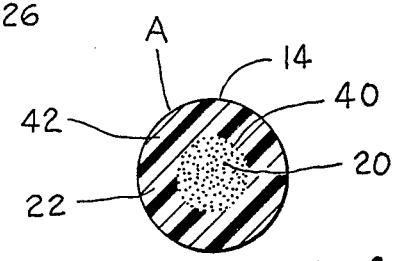
FIG. 7 is an enlarged cross-section of a polymeric mono strand for weaving as a spacer and prong penetrating warp element according to the invention.

In accordance with the present invention, the polymeric warp strands A (FIG. 7) described above are utilized as warp elements instead of the conventional warp yarns which typically include threads of nylon, polyester, and the like. The soft, pliable polymeric material 22 of the polymeric warp strand A permits the connector prongs 30 to pierce the woven cable structure without undue resistance or bending. Preferably polymeric strands, A is a reinforced strand such as textile reinforced polyvinyl chloride. Reinforcing fibers 20 are encapsulated generally in the central region of the strand defining a reinforcing core 40. Between the reinforcing core 40 and the outer diameter of strand A is defined a soft, pliable polymeric sheath layer 42.

The reinforcing fibers 20 provide sufficient tensile strength so that the polyvinyl chloride may be woven in the cable structure under tension as is necessary for weaving. However, the amount of reinforcing fibers present do not present an obstacle to the reliable penetration of the connector prongs 30.

Most important is the spacing function of the polymeric warp strands in maintaining the center to center spacing of the signal conductors 12 across the width of the cable. The conductors must be spaced across the cable in a highly accurate manner so that the conductor wires 12 are aligned with the slots 36 of connector prongs 30 of connector base 26 for piercing.

For an example, a common insulation displaceable connector has connector prongs on 50 mil centers. Electrical signal conductors 12 are spaced in the weave pattern of woven cable 10 with wires 13*b* on 50 mil centers as shown as distance X on FIG. 3A. In one embodiment, 28 gauge signal conductors are utilized having a 12.8 mil conductor wire diameter and a teflon insulation thickness of 6 mil The total outside signal wire conductor is approximately 24.8 mil in thickness. Polyvinyl chloride (PVC) warp strands A are woven between adjacent signal conductors 12 across the cable. The PVC warp strands have a 13 mil diameter or thickness. Two PVC warp strands occupy a space of 26 mil. The 6 mil insulation on the outside of each conductor wire provides an additional spacing of 12 mil so that a total of approximately 50 mil spacing is provided by the element dimensions. The exact 50 mil center to center spacing is maintained by the weaving process.

As can best be seen in FIG. 4, connector prongs 30 are arranged in two staggered rows on base 26. The adjacent connector prongs overlap each other in their staggered configuration on base 26. This means that with the prongs inserted into the cable, it is necessary that the prongs pass generally through all of the material of the polymeric warp strands 14. If signal conductors, such as 12*a* and 12*b* were spaced apart in a woven construction by conventional woven yarn elements such as nylon or polyester, the prongs would have to penetrate substantially more textile reinforcing material than in the case of the present invention where polymeric warp stands are utilized. The number of reinforcing textile fibers 20 present in the polymeric warp strands is not enough to impead reliable prong insertion or cause bending thereof.

The soft, pliable polyvinyl chloride material yields to the prongs and permits insertion through the woven cable and piercing of conductor insulation 13*a* for displacement and electrical contact in a reliable manner.

It has also been found that the well defined diametric dimension of polymeric mono strand A is highly effective for accurate lateral spacing of the conductors 12 in the weave pattern of cable 10 for piercing. While two polymeric mono strands A are included between adjacent signals, any number of strands may be used as desired for spacing. It is preferred that at least two strands be used.

As can best be seen in FIG. 2, the polymeric warp strands A,14 are woven in a one up one down pattern generally one hundred eighty degrees out of phase with each other so that crossing points 18 of intersection are defined. By weaving adjacent warp strands 14 out of phase, they are effectively prevented from rolling ver each other or bunching up. The rolling over and bunching up of warp yarns 14 would tend to cause the spacing between adjacent signal conductors 12 tonot be accurately maintained.

Further, in accordance with the woven cable and method of the present invention, it has been found that the cable may be subjected to heat treatment to cause the polymeric warp strands to fuse together at their points of contact such as points 18 so that a more stable and integral fabric structure is provided for woven cable 10.

In accordance with the invention, woven cable 10 may be formed in any length, may be cut into any desired length for the making of an individual low cross talk cable, and thereafter terminated in accordance with the invention by means of installation of an insulation displaceable connector 24 at each end of the cable in a very quick and reliable manner. A much more efficient and less costly termination process in provided in this manner. For example, if a cable of two inches in length is desired the cable only needs to be cut in a corresponding length and terminated by means of an IDC 24 at each end. In contrast, the prior art low cross talk twisted pair cable described previously can only be terminated at predetermined intervals, such as eighteen inches. Therefore, if a two inch cable is needed, sixteen inches of unneeded cable must be included which is a waste of cable material and money.

Thus, it can be seen that a highly advantageous construction for a woven cable and method may be had whereby commercial cable lengths may be run on weaving looms and thereafter made into any desired length with the expedience of being able to utilize an insulation displaceable connector. The labor extensive soldering of the woven cable is eliminated as has heretofore been done to terminate the woven cable to a pin type connector. Reliable penetration of the IDC is afforded by means of weaving soft pliable polymeric mono strands which are nonconductive, such as textile reinforced polyvinyl chloride, as spacers between adjacent signal conductors. This affords accurate spacing of the signal conductors and accurate piercing of conductors by the prongs of the IDC.

While a preferred embodiment of the invention has been described using specific terms, such description is for illustrative purposes only, and it is to be understood that changes and variations may be made without departing from the spirit or scope of the following claims.

What is claimed is:

1. A method of producing a flat woven electrical transmission cable which transmits electrical signals of the type which includes a plurality of insulated signal conductors having a conductor wire surrounded by insulation extending longitudinally in a warp direction in said cable, and weft elements interwoven with said signals conductors in said woven cables, wherein the method comprises:

weaving polymeric warp strand means in said woven cable between said signal conductors laterally spacing said signal conductors across the cable, inserting an insulation displaceable connector having a plurality of connector prongs into said woven cable to pierce and displace the insulation of said signal conductors and make electrical contact with the conductor wire of said signal conductors; and providing said polymeric warp strand means in a form having an outer covering of pliable polymeric material which readily yields to accept penetration of said connector prongs into said woven cable without bending of said prongs for reliable insulation displacement and electrical contact with said signal conductors.

2. The method of claim 1 wherein said polymeric strand means includes a polymeric mono warp strand.

3. The method of claim 2 including weaving at least two of said polymeric warp strands between adjacent signal conductors.

4. The method of claim 3 including weaving said polymeric warp strands in a manner that adjacent polymeric warp strands are woven generally one hundred eighty degrees out of phase with respect to each other preventing said polymeric warp strands from rolling over each other so that the prescribed lateral spacing between signal conductors is maintained and defining the crossing points of intersection.

5. The method of claim 4 including subjecting said woven cable to a heat treatment causing said polymeric warp strands to fuse together at points of contact in a manner that increased stability and integrity of the woven cable is provided.

6. The method of claim 1 wherein said polymeric warp strand means include longitudinal reinforcing fibers surrounded by said polymeric material providing tensile strength to said warp strands for weaving under tension.

7. The method of claim 1 wherein said polymeric warp strand means include textile reinforced polyvinyl chloride strands having textile reinforcing fibers extending longitudinally in each said strand in a manner that said warp strands are sufficiently pliable to yield for insertion of said connector prongs while having sufficient tensile strength for weaving under tension.

8. A method for constructing a flat woven electrical transmission cable having a plurality of signal conductors each of which consists of a conductor wire and a layer of insulation surrounding said conductor wire, and warp and weft elements interwoven with said signal conductors to form a weave pattern for said woven cable, wherein said method comprises:

weaving polymeric warp strands between said signal conductors in a warp direction of said cable to fix the lateral spacing of said signal conductors in said cable;

meaning said polymeric warp strands in the form of fiber reinforced polymeric warp strands having a reinforced core surrounded by a pliable polymeric material with said reinforcing core providing sufficient tensile strength for weaving said polymeric warp strands under tension;

terminating said woven cable by inserting an insulation displaceable connector at opposing ends of said woven cable in a manner that the connector prongs of said insulation displaceable connector easily penetrate said polymeric warp strands which displacing the insulation on said signal conductors to make electrical contact with said conductor wires.

9. The method of claim 8 including weaving said polymeric warp strands one hundred eighty degrees out of phase with respect to adjacent warp strands so that said warp strands intersect and do not move over each other and alter the spacing between adjacent signal conductors.

10. The method of claim 9 including subjecting said woven cable to heat treatment to cause said polymeric warp strands to fuse together at the points of contact.

11. The method of claim 8 wherein said reinforcing core of said polymeric strands is provided by a separate reinforcing material included within said polymeric strand in the form of elongated reinforcing fibers.

12. The method of claim 11 including providing said polymeric warp strands in a form with a sheath of pliable polymeric material encapsulating said reinforcing fibers.

13. A method of producing individual flat woven electrical transmission cables having a plurality of conductors arranged generally in a juxtaposed manner across the cable said method being of the type wherein a continous length of woven cable is woven in said weave pattern with said continuous length of cable being severed across sections which correspond to ends of said individual woven cable wherein the improvement comprises terminating each said individual woven electrical transmission cable by inserting an insulation displaceable connector into said woven cable in a manner that the connector prongs of said insulation displaceable connector pierce the insulation of said signal conductors at said prescribed spacing of their center lines; weaving spacer strands having well defined diameters between said signal conductors to maintain said prescribed center line spacing, and providing said warp spacer strands in the form of pliable material having sufficient tensile strength for weaving under tension and sufficient pliability to readily yield to said connector prongs for cable penetration and piercing of said signal conductor insulation.

14. The method of claim 13 including providing said warp spacer strands as mono strands having a reinforced core.

* * * * *